United States Patent [19]

Horenkamp

[11] Patent Number: 4,672,696

[45] Date of Patent: Jun. 16, 1987

[54] CONVERTIBLE SITTING/RECLINING FURNITURE ARTICLE

[75] Inventor: Franz Horenkamp, Bielefeld, Fed. Rep. of Germany

[73] Assignee: Ferdinand Lusch GmbH & Co. KG., Bielefeld, Fed. Rep. of Germany

[21] Appl. No.: 839,134

[22] Filed: Mar. 13, 1986

[30] Foreign Application Priority Data

Mar. 27, 1985 [DE] Fed. Rep. of Germany ... 8509131[U]

[51] Int. Cl.[4] ..... A47C 17/04

[52] U.S. Cl. ..... 5/17; 5/18 R; 5/20; 5/21; 5/19

[58] Field of Search ..... 5/17, 18 R, 18 B, 19, 5/20, 21, 14, 36; 297/338, 345; 108/145; 248/421

[56] References Cited

U.S. PATENT DOCUMENTS

| | | | |
|---|---|---|---|
| 1,260,367 | 3/1918 | Gilda | 5/14 |
| 1,448,127 | 3/1923 | Konrad | 5/14 |
| 1,590,090 | 6/1926 | Herz | 5/21 |
| 2,170,098 | 8/1939 | Stephenson | 108/145 |
| 2,328,411 | 8/1943 | Bergstrom | 5/21 |
| 3,187,351 | 6/1965 | Ducrot | 5/14 |
| 3,903,553 | 9/1975 | Metayer | 5/36 |

FOREIGN PATENT DOCUMENTS

| | | | |
|---|---|---|---|
| 185059 | 7/1955 | Austria | 5/21 |
| 2724133 | 4/1978 | Fed. Rep. of Germany | 5/18 R |
| 2937955 | 3/1981 | Fed. Rep. of Germany | 5/14 |
| 3000957 | 7/1981 | Fed. Rep. of Germany | 5/14 |
| 3138334 | 4/1983 | Fed. Rep. of Germany | 5/14 |
| 3201261 | 8/1983 | Fed. Rep. of Germany | 5/14 |
| 290829 | 5/1953 | Switzerland | 5/14 |
| 622937 | 5/1981 | Switzerland | 5/19 |
| 406710 | 3/1934 | United Kingdom | 5/14 |
| 719180 | 11/1954 | United Kingdom | 5/14 |
| 2070423 | 9/1981 | United Kingdom | 5/19 |

*Primary Examiner*—Thomas J. Holko
*Assistant Examiner*—Carl M. DeFranco, Jr.
*Attorney, Agent, or Firm*—Erwin S. Teltscher

[57] ABSTRACT

A convertible sitting/reclining furniture article comprises a main frame and a seat element which is supported at a predetermined elevation above ground. A bed frame can be pulled out of and pushed into the main frame in a drawer-like manner and includes a front side, a rear side and two lateral sides. An extension element is mounted on the bed frame for displacement between a retracted position and an extended position in which the extension element is disposed at the predetermined elevation to form an extension of the seat element by a five-bar kinematic linkage at each of the lateral sides of the bed frame. Each of the kinematic linkages includes a steering lever pivotally mounted at a first region of the extension element and at a first portion of the bed frame, and two steering links more remote from the front side of the bed frame than the steering lever and adjacent to the steering lever. The steering links are articulately connected to one another at a connection region and one of them is pivotally connected to a second region of the extension element while the other is pivotally connected to a second portion of the bed frame which is spaced from said first portion by a distance exceeding the distance between the first and second regions of the extension element. The steering links assume a straight-line orientation with respect to one another in the extended position of the extension element to block the connection region against pivoting in at least one of its pivoting directions.

2 Claims, 9 Drawing Figures

FIG. 6
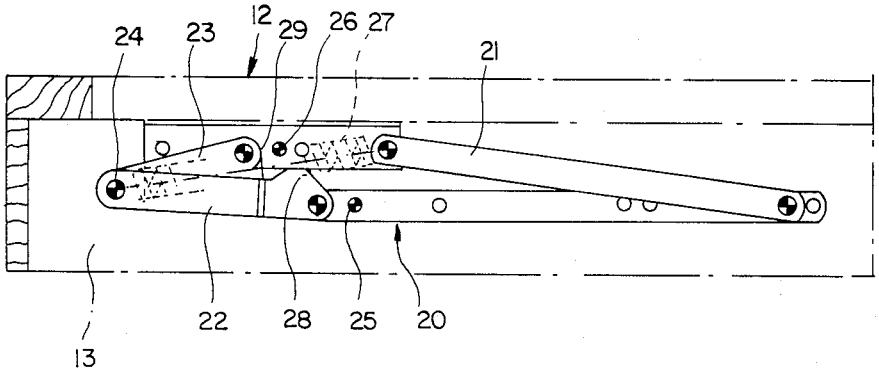
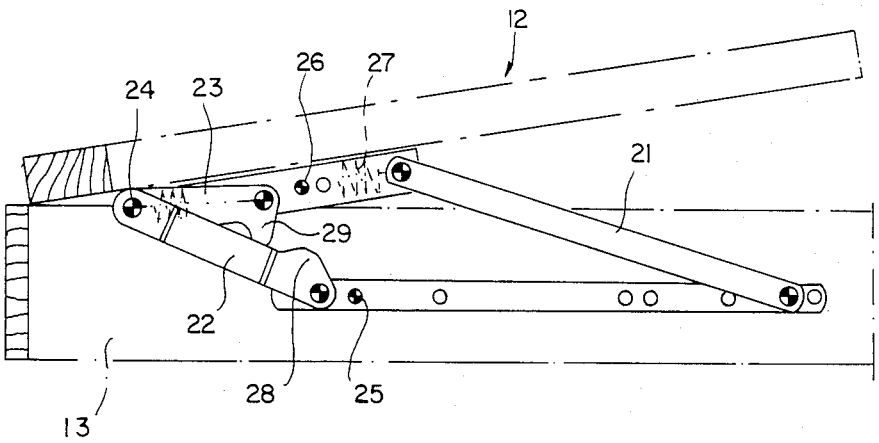
FIG. 7

FIG.8
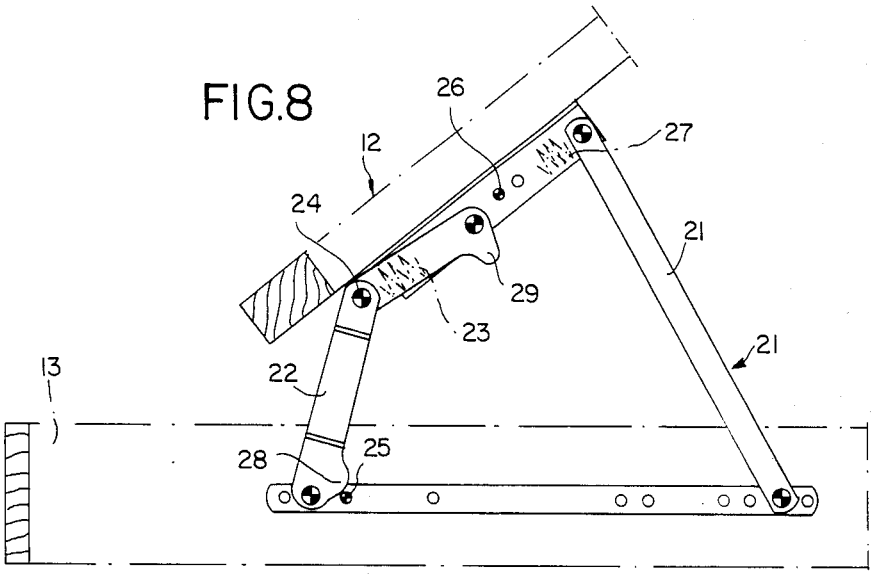
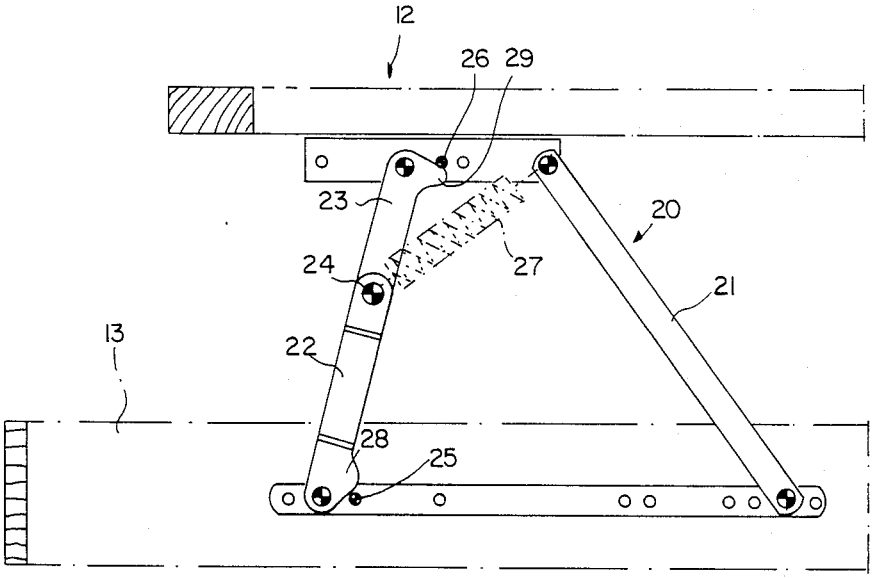
FIG.9

CONVERTIBLE SITTING/RECLINING FURNITURE ARTICLE

BACKGROUND OF THE INVENTION

The present invention relates to articles of furniture in general, and more particularly to a convertible sitting/reclining furniture article.

There are already known various constructions of convertible sitting/reclining furniture articles, such as sofa beds, recliners or the like, among them such which include a main frame and a bed frame which can be pulled out of and pushed back into the main frame, as well as an extension element which is mounted on the bed frame for pivoting between its retracted position in the main frame and its extended position in which it is situated at the same elevation as a seat element of the furniture article to form an extension thereof. In such known constructions, pivotal mounting arrangements are usually arranged at the two lateral sides of the bed frame and mount the extension element on the bed frame for its pivotal movements between the retracted and extended positions. However, experience with the known furniture articles of this type has shown that they are usually very complex, cumbersome to handle, and expensive to manufacture and therefore costly, and yet in many instances it is not assured that the extension element will remain in its extended position for as long as needed.

SUMMARY OF THE INVENTION

Accordingly, it is a general object of the present invention to avoid the disadvantages of the prior art.

More particularly, it is an object of the present invention to provide a convertible sitting/reclining furniture article in which the extension element is positively guided during its pivotal movement by the pivotal mounting arrangements.

Still another object of the present invention is to construct the furniture article of the type here under consideration in such a manner that the extension element is arrested in its extended position by the pivotal mounting arrangements.

In keeping with these objects and others which will become apparent hereafter, one feature of the present invention resides in a sitting furniture article convertible into a reclining furniture article, this furniture article comprising a main frame; a seat element; means for supporting the seat element at a predetermined elevation above ground; a bed frame which can be pulled out of and pushed into the main frame in a drawer-like manner and includes a front side, a rear side and two lateral sides; an extension element; and means for mounting the extension element on the bed frame for displacement between a retracted position and an extended position in which the extension element is disposed at the predetermined elevation to form an extension of the seat element. The key features are that such mounting means includes a five-bar kinematic linkage at each of the lateral sides of the bed frame, that each of the kinematic linkages includes a steering lever pivotally mounted at a first region of the extension element and at a first portion of the bed frame and arranged closer to the front side of the bed frame, and two steering links arranged more remotely from the front side of the bed frame and adjacent to the steering lever and articulately connected to one another at a connection region, that one of the steering links is pivotally connected to a second region of the extension element at a predetermined distance from the first region while the other of the steering links is pivotally connected to a second portion of the bed frame which is spaced from the first portion by a distance exceeding the predetermined distance, and that the steering links assume a straight-line orientation with respect to one another in the extended position of the extension element to block the connection region against pivoting in at least one pivoting direction thereof.

As a result of this particular construction of the pivotal mounting arrangement, it is feasible for the user to effectively and easily move the mattress element of such a convertible sitting furniture article into a position where he or she can easily move the mattress element into its extended position of use without having to resort to any deliberations or, worse yet, having to consult the operation manual for helpful operating instructions.

On the basis of the construction of the pivotal mounting arrangement in accordance with the present invention, it is even possible to accomplish the pivotal movement of the mattress element without having to exert any substantial force.

A further advantage of the construction according to the present invention results from the fact that, for all intents and purposes, the pivotal movement range of the mattress element does not extend beyond the area which is predetermined by the outline of the bed frame so that such a furniture article can be used even under circumstances where the available space is limited.

It is further advantageous in this context that the corresponding pivotal mounting arrangement assumes its arrested condition when the mattress element reaches its extended position, so that there is no need for providing any additional support, for instance a covering element, on which the mattress element would rest in its extended position. This means that the configuration of the bed frame, especially the shape and arrangement of a front covering plate thereof, can be determined exclusively on the basis of optical and esthetic appeal considerations, without regard for any stability-determined dimensioning.

According to another advantageous facet of the present invention, the sitting furniture article further comprises two abutment pins mounted on the extension element in a stationary manner and on the bed frame, respectively, at the regions of the respective steering links and in directions away from the steering links and towards the steering lever. It is also advantageous when the steering links include respective abutment noses at their regions facing the respective abutment pins. Last but not least, it is advantageous when the sitting furniture articles further comprises, at each of the kinematic linkages, a tension spring which is connected with one end thereof at the first region of the extension element and with the other end thereof at the connecting region of the steering links.

BRIEF DESCRIPTION OF THE DRAWING

FIGS. 6 to 9 are simplified side elevational views of one pivotal mounting arrangement employed in the sitting furniture article of FIGS. 1 to 5, together with parts of a mattress element and bed frame, in different relative positions.

DETAILED DESCRIPTION OF THE PREFERRED EMBODIMENT

Figure 1:
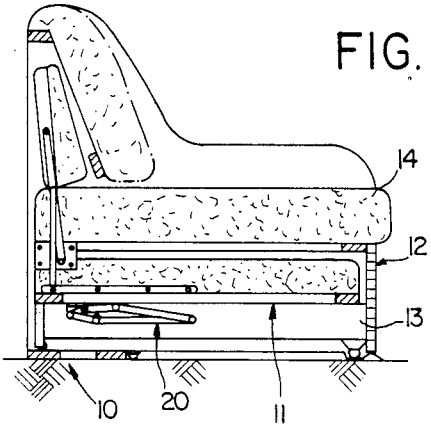
FIGS. 1 to 3 are sectional views of a sitting furniture article of the present invention in various positions thereof.

Referring now to the drawing in detail, and first to FIGS. 1 to 5 thereof taken in conjunction with one another, it may be seen that the reference numeral 10 has been used therein to identify a main frame, while the reference numeral 11 designates a seat frame which can be pulled out of the main frame 10.

Figure 4:
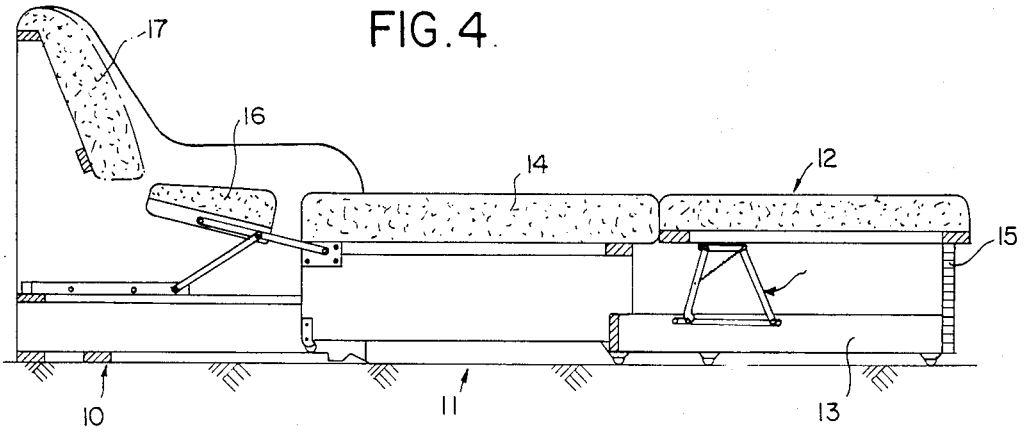
FIGS. 4 and 5 are views similar to those of FIGS. 1 to 3 but after the sitting furniture article has been converted into different forms of a reclining furniture article.
Figure 5:
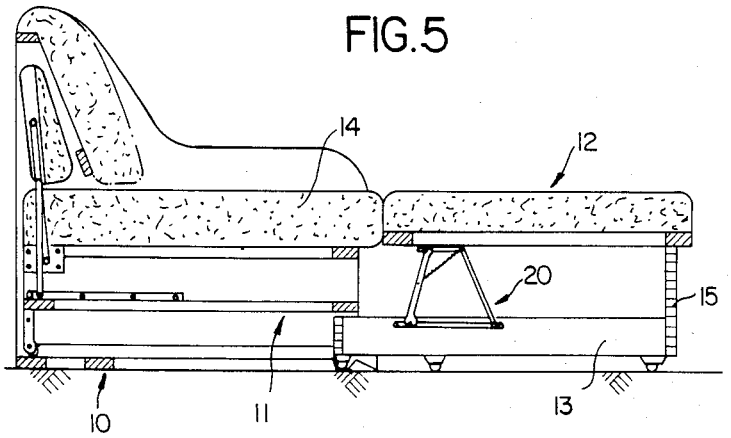

A mattress element 12 is pivotally mounted on the seat frame 11 by means of two laterally arranged kinematic linkages 20 in such a manner that the mattress or extension element element 12 can be pivoted up from a non-use or collapsed position which is depicted in FIG. 1 of the drawing into a use or extended position which is shown in FIGS. 4 and 5 of the drawing and in which the mattress element 12 is situated at the same elevation as a seat cushion or seat element 14 which is supported on the seat frame 11.

Herein, the kinematic linkages 20 are mounted, on the one hand, on the mattress element 12 and, on the other hand, on a bed frame 13. A free front side of the bed frame 13 is provided with a front frame covering element 15. The bed frame 13 is provided with rollers or casters by means of which it is movably supported on a floor. The bed frame 13 can be pulled out of the seat frame 11 until it abuts against a non-illustrated end abutment.

It will, of source, be understood from the title and from the drawing that a user can initiate actuation of a return movement of the extension element from an extended position thereof to its retracted position.

Figure 2:
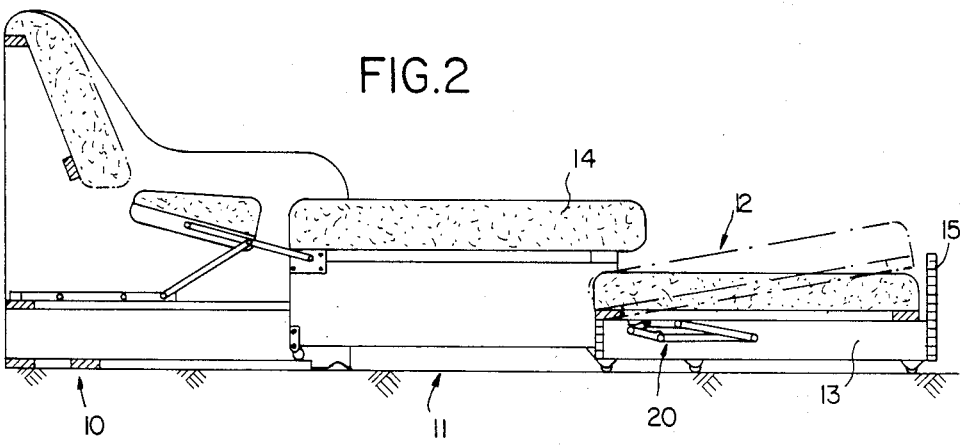
Figure 3:
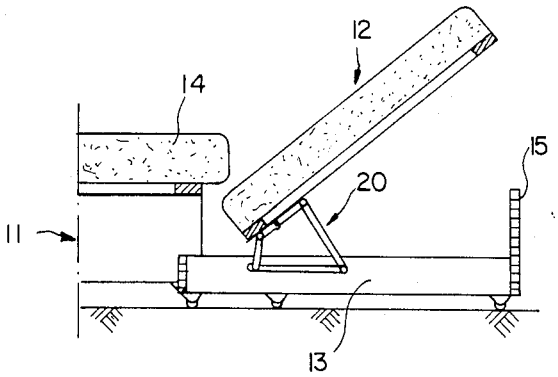

FIG. 2 illustrates a beginning of a pivoting of the mattress element 12 out of its collapsed position. In FIG. 2, as well as in FIG. 3, it can be very clearly seen that at first the free front side of the mattress element 12 is lifted while the oppositely located rear side remains situated underneath a projecting edge region of the seat cushion 14. Herein, the kinematic linkages 20 provide the pivoting axis for such pivoting movement.

FIG. 4 illustrates the conversion of the original sitting furniture article into a reclining furniture article in which the seat cushion 14 and the mattress element 12 are situated at the same elevation, while a head rest 16 is so pivoted in a known manner that it bridges an intermediate space which has come into being between the seat cushion 14 and a back rest 17 as a result of the conversion of the sitting furniture article into the reclining furniture article.

Another position of the sitting furniture article is shown in FIG. 5 of the drawing. It may be seen here that the seat frame 11 with the associated seat cushion 14 is now situated at the region of the main frame 10, while the mattress element 12 is pivoted up in the above-described manner to the elevation of the seat cushion 14, so that there is obtained in this manner a possibility, which may be preferred by the user of the sitting furniture article, of sitting on the sitting furniture article with outstretched legs.

FIGS. 6 to 9 of the drawing show one of the kinematic linkages 20 in various positions thereof. The kinematic linkage 20 is shown to include a steering lever 21. The steering lever 21 is mounted, on the one hand, on the bed frame 13 and, on the other hand, on the mattress element 12, in each instance in a pivotable manner. In the illustrated construction, the steering lever 21 is arranged in the direction toward the free front side of the mattress element 12.

Two steering links 22 and 23, which are articulated to one another by a common pivot 24, are arranged adjacent to the steering lever 21. One of such steering links 22 and 23 is connected to the mattress element 12 while the other is connected to the bed frame 13, also in a pivotable manner.

FIG. 6 of the drawing shows the kinematic linkage 20 in a position corresponding to the non-use or collapsed position of the mattress element 12, this particular position being also illustrated in FIG. 1 of the drawing. In this position, the kinematic linkage 20 corresponds to a five-bar linkage, that is, it is inherently unstable by itself.

This instability condition changes at the commencement of the pivotal movement of the mattress element 12 towards its extended position, inasmuch as the steering links 22 and 23 come into abutment at the region of their common pivot 24 with the bottom side of the mattress element 12, which means that the link region between the steering link 23 and the mattress element 12 is blocked and, as a result of this blocking, the kinematic linkage 20 becomes a four-bar linkage. In this manner, there is obtained, of necessity, a stable condition of the kinematic linkage 20.

The same reasoning also applies to the pivoted position of the mattress element 12 which is illustrated in FIG. 8 of the drawing. In this position, however, an abutment nose 28 which is provided on the steering link 22 at the connection region with the bed frame 13 and which points in a direction toward the steering lever 21 additionally engages an abutment pin 25 which is secured in position on the bed frame 13.

In FIG. 9, the kinematic linkage 20 is illustrated in a position which it assumes when the mattress element 12 is in its extended or use position corresponding to that depicted in FIGS. 4 and 5 of the drawing. In this particular position, the steering links 22 and 23 are disposed in a straight position with respect to one another, that is, they extend along a common straight line. The abutment nose 28 which has been mentioned before in connection with the description of FIG. 8 remains in engagement with the abutment pin 25. Another abutment nose 29 is provided on the other steering link 23 and also points in a direction toward the steering lever 21. The abutment nose 29 engages an additional abutment pin 26 which is secured in position to the mattress element 12, so that the kinematic linkage 20 is held in a stable position and keeps the mattress element 12 in its position illustrated in FIG. 9. For aiding the pivoting of the steering links 22 and 23 and for stabilizing the kinematic linkage 20, there is provided a tension spring 27 which is secured, on the one hand, to the common pivot 24 and, on the other hand, to a connecting region of the steering lever 21 with the mattress element 12.

An important feature of the present invention is that, as can be easily ascertained from FIGS. 7 to 9 of the drawing, the distance between the connection region of the steering link 23 and the connection region of the steering lever 21 to the mattress element 12 is smaller than the distance between the connection region of the steering link 22 and the connection region of the steering lever 21 to the bed frame 13.

What is claimed is:

1. A sitting furniture article convertible into a reclining furniture article, comprising, in combination a main frame;

a seat element;

means for supporting said seat element at a predetermined elevation above ground;

a bed frame which can be pulled out of, and pushed into said main frame in a drawer-like manner, including a front side, a rear said, and two lateral sides;

an extension element;

means for mounting said extension element on said bed frame for displacement between a retracted position through an intermediate position to an extended position, in which extended position said extension element is disposed at said predetermined elevation to form an extension of said seat element, said mounting means including a five-bar kinematic linkage at each of said lateral sides of said bed frame, said five-bar kinematic linkage being operable in successive first and second four-bar kinematic linkage phases, each of said five-bar kinematic linkages including a steering lever pivotally mounted at a first region of said extension element, and at a first portion of said bed frame, and arranged close to said front side of said bed frame, and two steering links arranged more remotely from said front side of said bed frame than said steering lever, adjacent to said steering lever, and pivotably connected to one another at a connection region, one of said steering links being pivotally connected to a second region of said extension element at a predetermined distance from said first region, while the other of said steering links is pivotally connected to a second portion of said bed frame which is spaced from said first portion by a prearranged distance exceeding said predetermined distance, said steering links assuming a straight-line orientation with respect to one another in the extended position of said extension element to lock said connection region against pivoting in at least one pivoting direction thereof, two abutment pins stationarily mounted on said extension element and on said bed frame, respectively, at regions of the respective steering links, and in directions towards said steering lever, and away from said steering links, and a tension spring connected at each of said kinematic linkages with one end thereof at said first region of said extension element, and with the other end thereof at said connecting region of said steering links, whereby, upon said extension element being pivotally moved in said first phase from said retracted position frontwise to said intermediate position in a first angular direction, said one of said steering links is constrained to follow movement of said extension element until the other of said steering links abuts one of said abutment pins, being temporarily immobilized thereby, so that, upon reaching said intermediate position and subsequent pivotable movement of said extension element in a second angular direction opposite to said first angular direction towards said extended position in said second phase, said spring urges said connecting region towards said steering lever, and said one of said steering links is constrained to move in said first angular direction until it abuts the other of said abutment pins, at which time said second steering link points in a direction similar to that of said first steering link, and said extension element has reached said extended position;

while in an actuated return movement of said extension element rearwise from said extended position to said intermediate position in said first angular direction, said one of said steering links is caused to assume a direction different from that of the other of said first steering links, and thereafter, upon movement of said extension element further rearwise, and away from said intermediate position, said one of said steering links is again constrained to follow movement of said extension element, until said extension element has reached said retracted position.

2. The sitting furniture article as defined in claim 1, wherein said steering links includes respective abutment noses at their regions facing the respective abutment pins.

* * * * *